United States Patent [19]

Pitha

[11] Patent Number: 4,805,591

[45] Date of Patent: Feb. 21, 1989

[54] FIREBOX OF PREFABRICATED BLOCKS, ASSEMBLAGE THEREFOR AND METHOD OF ASSEMBLY

[76] Inventor: Jay R. Pitha, Eagle Rock Village, Bldg. 34, Apt. 8-A, Budd Lake, N.J. 07828

[21] Appl. No.: 186,730

[22] Filed: Apr. 22, 1988

Related U.S. Application Data

[63] Continuation of Ser. No. 16,122, Feb. 18, 1987, abandoned.

[51] Int. Cl.[4] ..... F24B 7/00

[52] U.S. Cl. ..... 126/500; 52/218; 52/219; 110/336

[58] Field of Search ..... 110/336, 338; 126/120, 126/121, 130, 131, 143; 52/218, 274, 275, 284, 584, 604, 606, 608, 610, 219, 311, 211, 747

[56] References Cited

U.S. PATENT DOCUMENTS

| | | | |
|---|---|---|---|
| 3,460,525 | 8/1969 | Bryant | 52/218 |
| 3,721,225 | 3/1973 | Tidwell | 126/120 |
| 3,908,630 | 9/1975 | Burcham | 126/120 |
| 4,248,206 | 2/1981 | Orthey, Jr. | 126/143 |
| 4,305,374 | 12/1981 | Taylor | 126/143 |
| 4,478,208 | 10/1984 | Pitha | 52/218 |

FOREIGN PATENT DOCUMENTS

| | | | |
|---|---|---|---|
| 7901517 | 8/1980 | Netherlands | 126/143 |

*Primary Examiner*—Samuel Scott
*Assistant Examiner*—Noah Kamen
*Attorney, Agent, or Firm*—Hopgood, Calimafde, Kalil, Blaustein & Judlowe

[57] ABSTRACT

Fifteen prefabricated refractory concrete blocks, consisting of ten different sizes and/or shapes assemble to provide a replacement firebox of U-shape with facing side walls joined by a rear wall. In one embodiment a metal lintel is disposed at the front upper boundary of the structure produced from the fifteen blocks, the lintel resting on the side walls bridging the opening therebetween and defining the upper boundary of the hearth opening. A masonry transition cone is erected atop the side walls and lintel. In a second embodiment, trapezoidal sheet metal panels are assembled to form a transition cone above the U-shape structure. The bottom courses are produced from blocks that are in the form of oblique rectangular parallelepipeds. These are arranged so that the joints are staggered vertically. The upper portion of the rear wall below the transition cone is formed from oblique trapezoidal prismatic blocks. Certain of the blocks in addition are truncated.

25 Claims, 8 Drawing Sheets

18
19
11
17
11
13
11
13
16
15
14
12
12
12
35
34
36
27
29
28
26
20
18
11
13
11
13
33
32
31
56
54
53
55
32
51
31
54b
54a
52
52a
50
30
49
20
45
16
48
19

61
H
64
40
62
60
65
L
63
W
71
41
67
68
66
69
70
43
73
72
74
75
42
44

45
78
46

76

79

49
47
77
80
82
81
48

FIREBOX OF PREFABRICATED BLOCKS, ASSEMBLAGE THEREFOR AND METHOD OF ASSEMBLY

This application is a continuation, of application Ser. No. 016,122, filed Feb. 18, 1987, now abandoned.

BACKGROUND OF THE INVENTION

The present invention relates to a firebox for an open hearth fireplace and, more particularly, primarily to a replacement firebox for deteriorated metal fireboxes.

For many years, various metal fireplace units have been used by builders to facilitate fireplace construction. Such units, referred to in the trade as "Builder Boxes", provide a functionally effective design providing a form easily surrounded by masonry, faced with masonry veneer, and surmounted by a chimney. Highly skilled masons knowledgeable in fireplace construction are not needed and much of the guesswork is eliminated from the construction of masonry fireplaces. Unfortunately, metal fireboxes are not durable and depending upon climatic conditions and the nature of the wood burned therein rarely last as long as 25 years, and generally fail on average within seven to ten years.

When a metal firebox fails, a result of metal corrosion, the fireplace is unusable until the defect is corrected. Several corrective methods have heretofore been employed. One procedure involves cutting away the rusted-out or deteriorated area in the firebox and welding in a new piece of sheet metal. This remedy is only temporary because the same area is likely to rust-out again, and other faults are likely to develop.

Another procedure is to tear down the entire fireplace and rebuild it with a more durable type. This represents a very expensive alternative. Yet another procedure involves cutting the metal firebox out of the surrounding masonry and replacing it with a masonry liner of firebrick. This is difficult and labor intensive, and there is a tremendous shortage of masons capable of this type of construction.

In U.S. Pat. No. 4,470,399, issued Sept. 11, 1984 for "Fireplace Construction" there is disclosed and claimed a fireplace comprising a stacked plurality of courses of modular prismatic blocks laid upon a base to define a firebox region of opposed side walls and a rear wall contiguous thereto. The blocks are of cast refractory concrete, and the patented fireplace employs specially configured blocks for establishing serpentine flue passages and a heat exchange air circulatory system.

It is, therefore, an object of the present invention to provide a simple and readily installable replacement firebox for a deteriorated metal firebox.

Another object is to provide a masonry replacement for the metal firebox of an existing fireplace which replacement is easy to install and which is not dependent upon highly skilled masons.

Yet another object of the present invention is to provide an inexpensive replacement firebox for a deteriorated metal firebox.

SUMMARY OF THE INVENTION

In accordance with one aspect of the present invention there is provided a firebox for an open hearth fireplace comprising an assemblage of prefabricated modular masonry components in which a plurality of courses of refractory concrete blocks are superposed one above the other to the height of the hearth opening forming a U-shape first structure with facing side walls joined by a rear wall, and a transition cone located atop said first structure for interconnecting said first structure with a chimney, said first structure having side walls of uniform thickness which diverge in the forward direction from said rear wall, said rear wall having a lower portion of uniform thickness and vertical surfaces, and having an adjacent upper portion wherein the inner surface is inclined forwardly in the upward direction, and said transition cone has a front inner surface that is inclined rearwardly in the upward direction.

In accordance with a further aspect of the present invention there is provided a method for replacing metal fireboxes in an open hearth fireplace which comprises in combination the steps of removing the metal firebox, inspecting and performing any needed repair to the existing hearth slab, assembling with refractory mortar on said hearth slab a plurality of courses of prefabricated refractory concrete blocks, laying one course above the previous course to the height of the hearth opening and forming thereby a U-shape first structure with facing side walls joined by a rear wall, and disposing a transition cone between said first structure and an existing chimney, said first structure having side walls of uniform thickness which diverge in the forward direction from said rear wall, said rear wall having a lower portion of uniform thickness and vertical surfaces, and having an adjacent upper portion wherein the inner surface is inclined forwardly in the upward direction, and said transition cone has a front inner surface that is inclined rearwardly in the upward direction.

Finally, in accordance with yet another aspect of the present invention there is provided an assemblage of prefabricated refractory concrete blocks for erecting a firebox for an open hearth fireplace, said assemblage comprising ten differently sized and shaped blocks, some of which blocks are duplicated to provide at least fifteen of said blocks which when laid in courses of three blocks each produce a U-shape structure with facing side walls joined by a rear wall, said blocks being shaped to form said side walls with uniform thickness diverging in the forward direction, and structural members for erecting a transition cone to surmount said U-shape structure.

BRIEF DESCRIPTION OF THE DRAWINGS

The invention will be better understood after reading the following detailed description of the presently preferred embodiments thereof with reference to the appended drawings in which:

FIG. 3 is a perspective view of the firebox of FIG. 2 with chimney, hearth and veneer omitted for clarity;

The same reference numerals are used throughout the drawings to designate the same or similar component.

DETAILED DESCRIPTION OF THE PRESENTLY PREFERRED EMBODIMENTS

Figure 1:
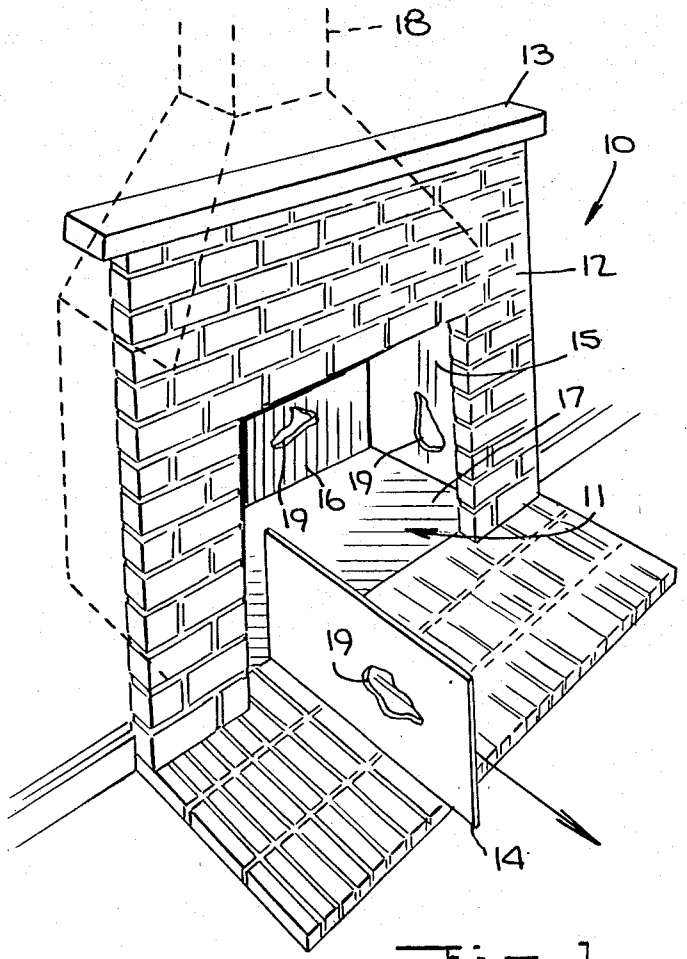
FIG. 1 is a perspective view of a brick faced fireplace with a deteriorated metal firebox illustrating somewhat diagrammatically the removal of the metal sheets.

Referring to the drawings, and particularly to FIG. 1, there is shown a brick faced fireplace 10 having a hearth 11, and brick veneer face 12 topped by a mantel 13, and a metal firebox consisting of a series of panels of which two side panels 14 and 15, a rear panel 16, and a bottom panel 17 are visible. Shown in phantom lines is the outline of a chimney 18.

Figure 2:
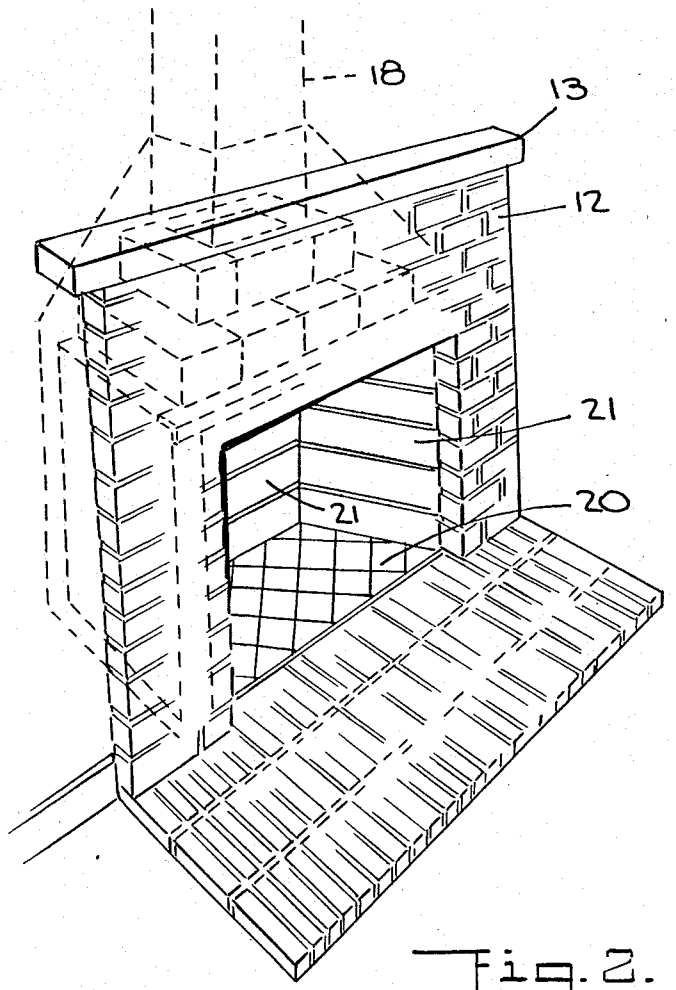
FIG. 2 is a perspective view of the fireplace of FIG. 1 after rebuilding with a masonry firebox in accord with a first embodiment of the present invention.

As illustrative of the deterioration of the metal firebox, the panels are shown to contain corroded areas 19, and the panel 14 is shown schematically as in the process of being removed. After the entire metal firebox is removed, it is replaced by a firebox in accordance with the present invention, the renovated fireplace being shown in FIG. 2 having a reconstructed hearth of firebrick 20 and walls 21 of prefabricated concrete refractory blocks.

Figure 4:
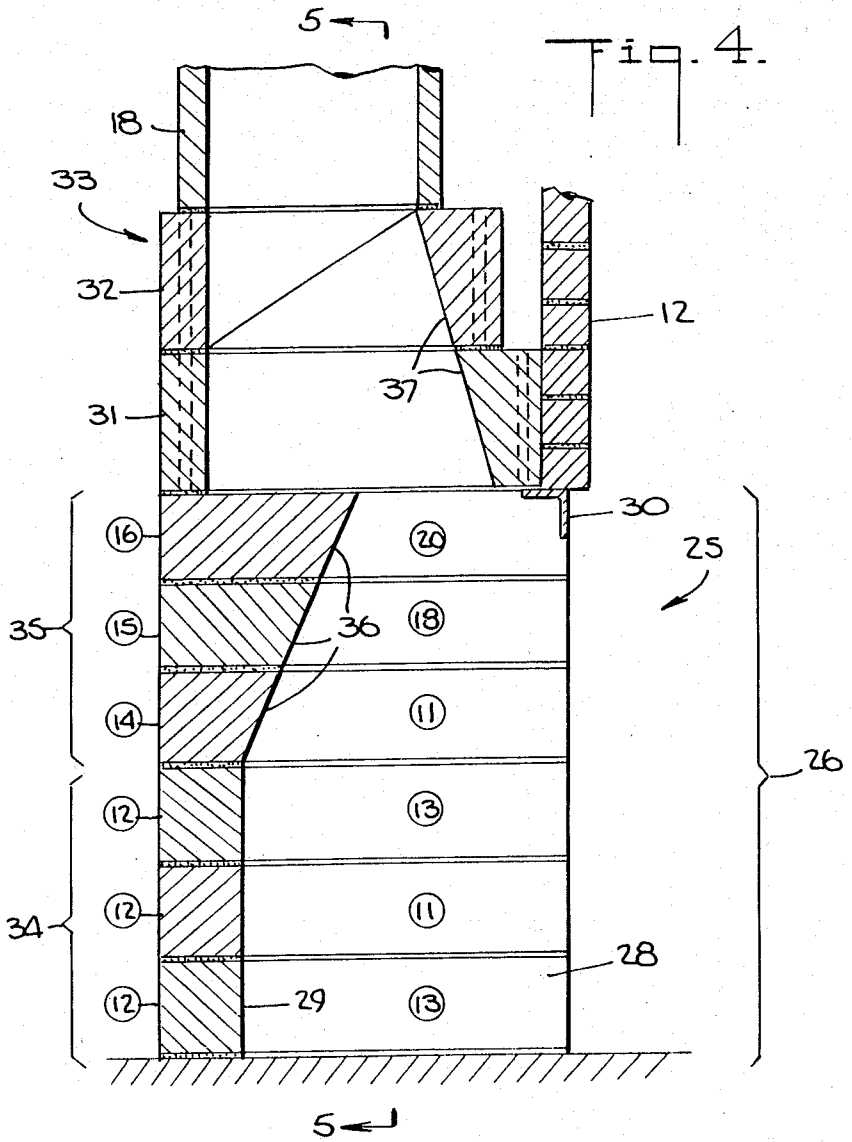
FIG. 4 is a vertical back-to-front sectional view of the firebox of FIG. 3 including a section of the chimney and part of the face veneer.
Figure 5:
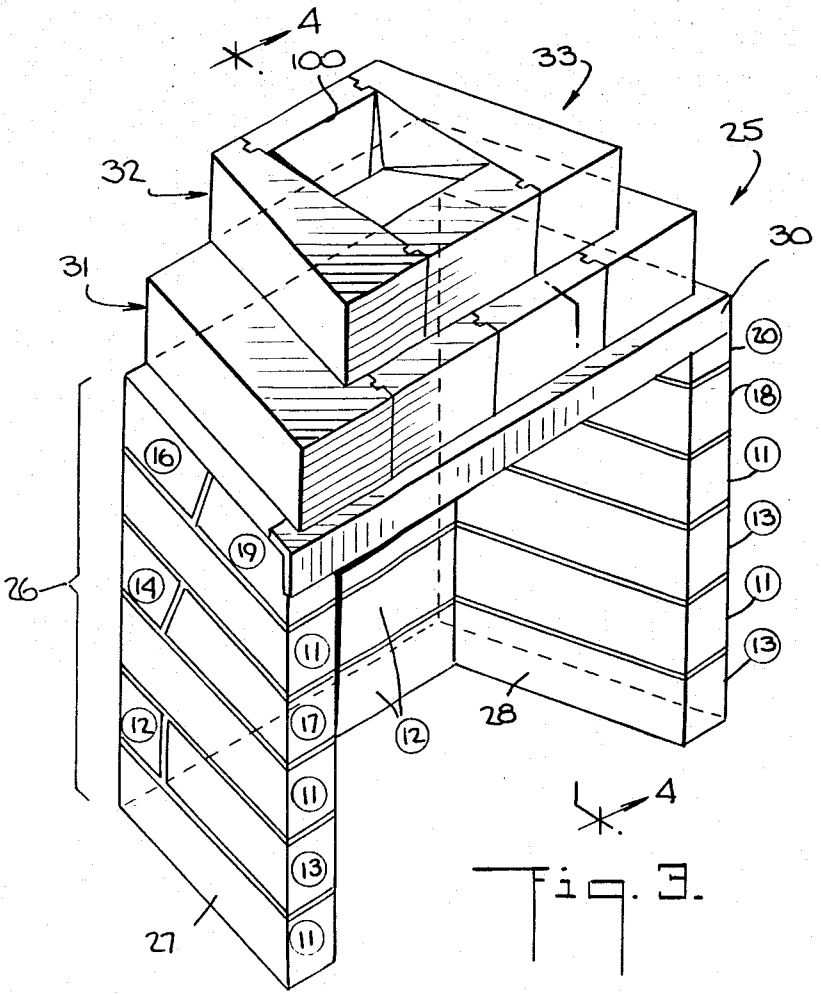
FIG. 5 is a vertical sectional view taken along the line 5—5 in FIG. 4.
Figures 5, 6, 7, 8:
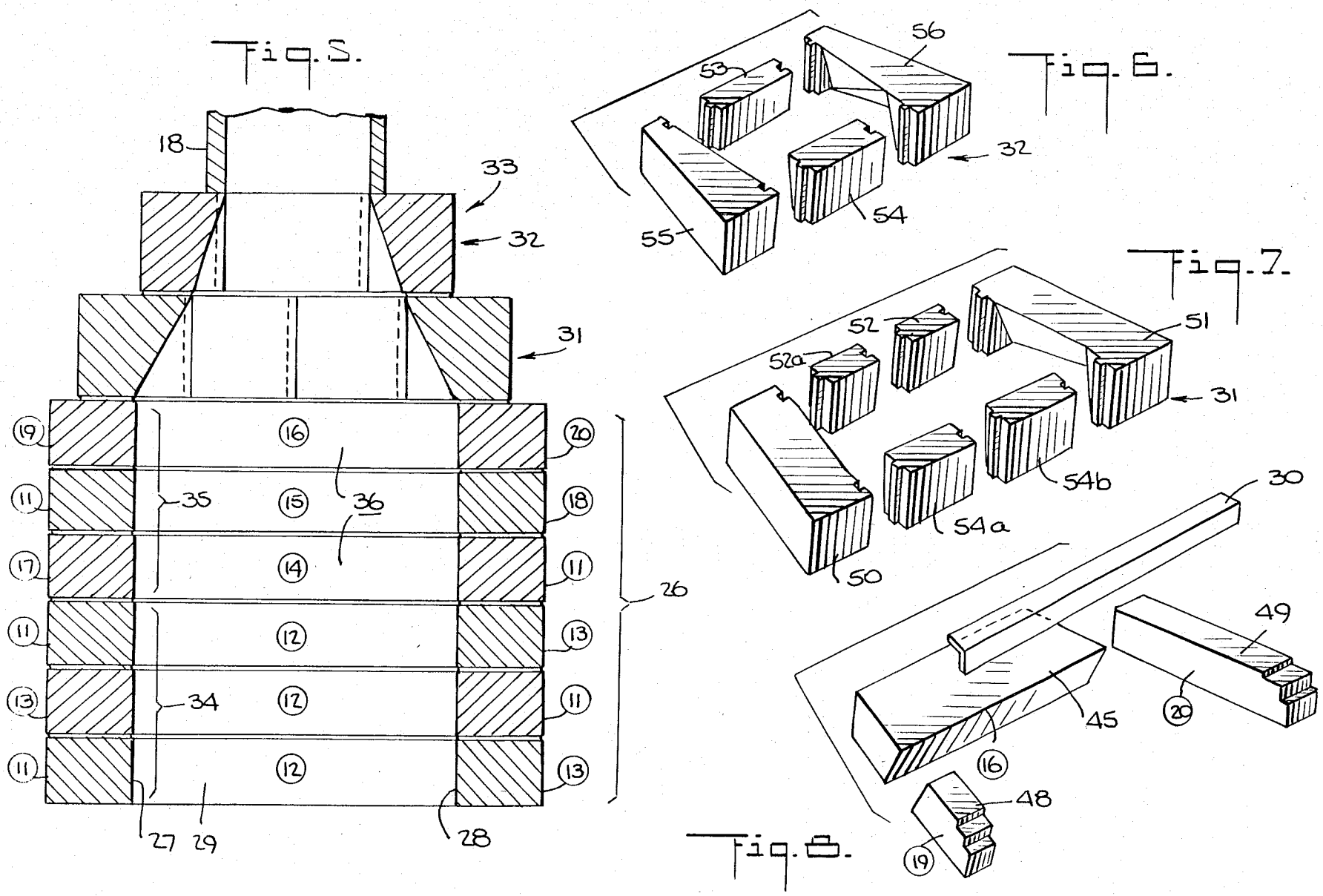
FIG. 6 is an exploded perspective view of the top course of blocks constituting part of the transitional section at the top of the firebox of FIG. 3.
FIG. 7 is a view similar to FIG. 6 of the next lower course of blocks, also forming part of the transitional section.
FIG. 8 is an exploded view of the next lower course of blocks including a steel angle iron lintel.

Reference now should be had to FIGS. 3, 4 and 5 showing the fully assembled refractory block firebox in relation to the chimney 18 and to the face brick veneer 12 above the fireplace opening. The various numerals within a circle associated with the various blocks identify the figure of the drawings that shows the particular block in detail.

The masonry firebox consists of two principal sections, one of which is further divisible into two sub-sections. Thus, it will be seen that the firebox, designated generally by the reference numeral 25, is formed from an assemblage of prefabricated modular masonry components in which a plurality of courses of the refractory concrete blocks are superposed one above the other to the height of the hearth opening forming a U-shape first structure 26 with facing side walls 27 and 28 joined by a rear wall 29. In this embodiment a metal lintel, for example the steel angle iron 30, is disposed at the front upper boundary of the hearth opening. Additional courses of prefabricated modular refractory concrete blocks, 31 and 32, are supported by the lintel 30 and the first structure 26 and provide a masonry transition cone 33 between the first structure 26 and the chimney 18. The side walls 27 and 28 of the first structure 26 are of uniform thickness throughout and diverge in the forward direction from the rear wall 29. The rear wall 29 has a lower portion 34 of uniform thickness and vertical surfaces, and an adjacent upper portion 35 wherein the inner surface 36 is inclined forwardly in the upward direction. Also, the transition cone 33 has a front inner surface 37 that is inclined rearwardly in the upward direction.

Figure 9:
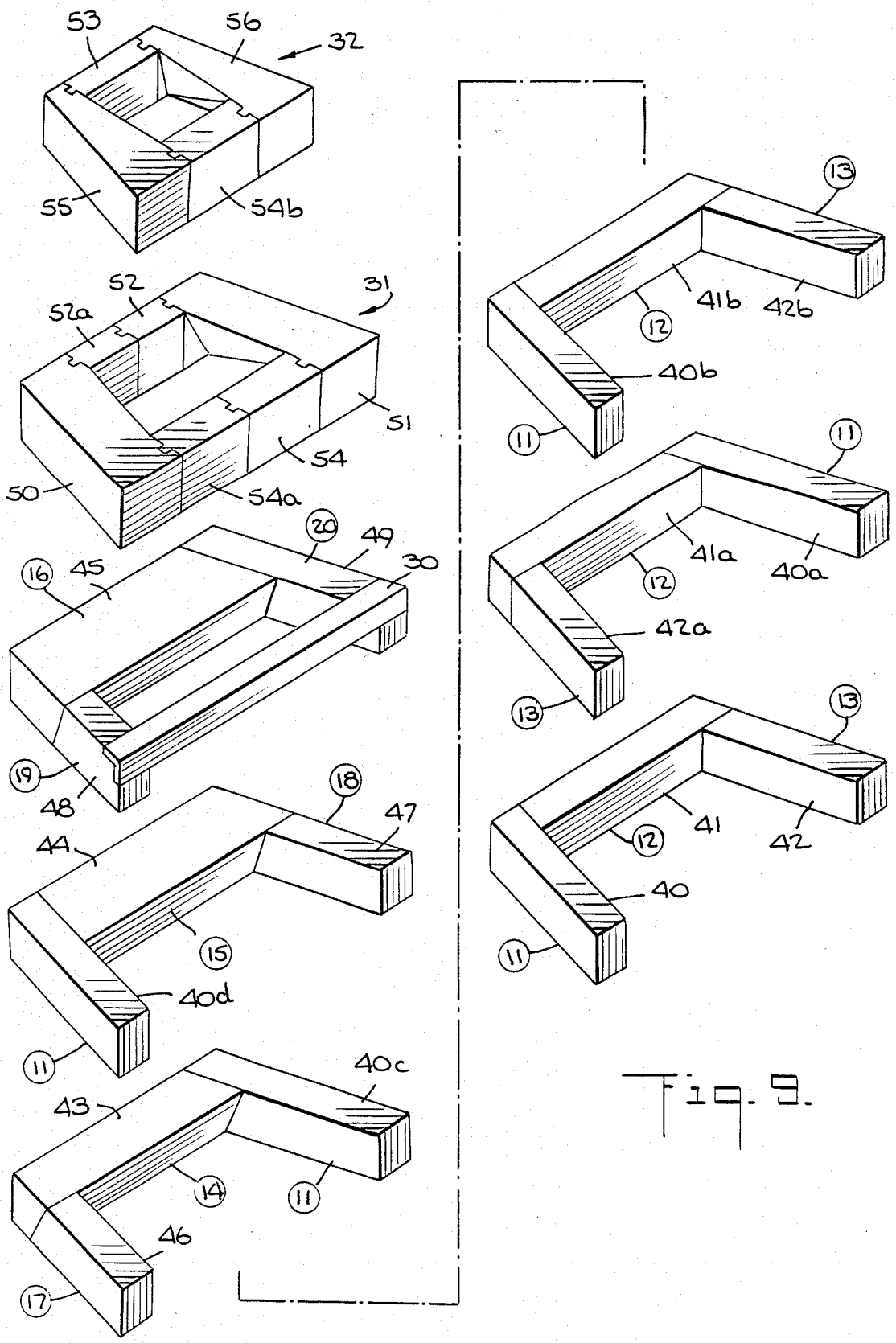
FIG. 9 is an exploded view of all eight courses of blocks constituting the embodiment of the invention illustrated in FIG. 3.
Figure 10A:
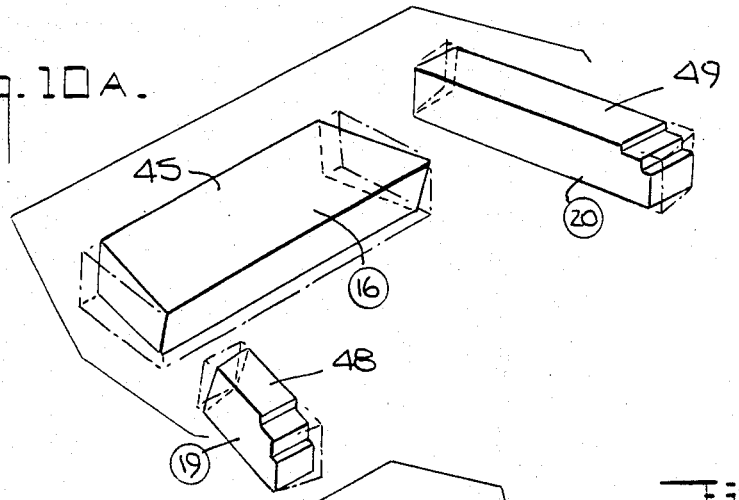
FIG. 10A is an exploded view of the lintel level course of blocks, modified by the addition of phantom lines to better illustrate the various bevel and miter angles and planes.
Figure 10B:
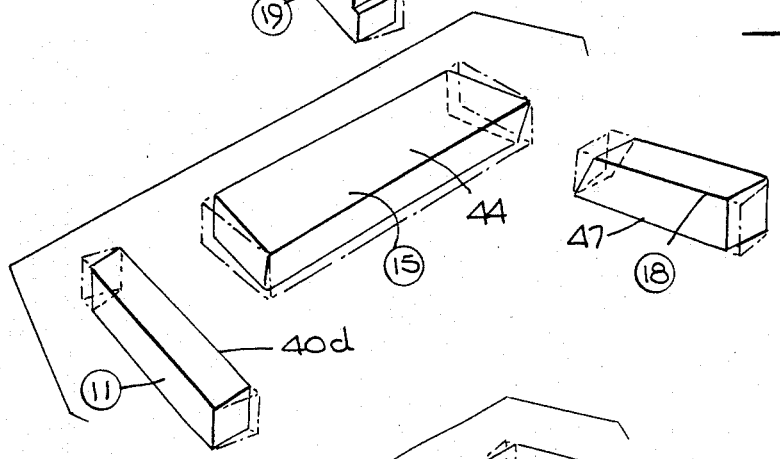
FIG. 10B is a view similar to FIG. 10A of the next lower course of blocks.
Figure 10C:
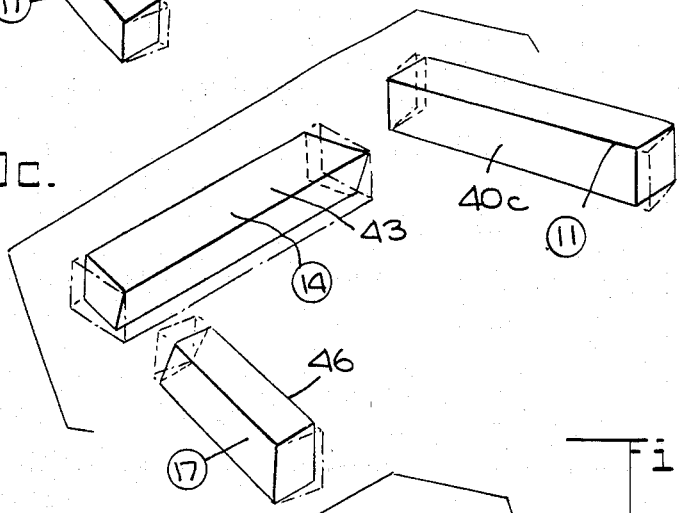
FIG. 10C is a view similar to FIG. 10B of the next lower course of blocks.
Figure 10D:
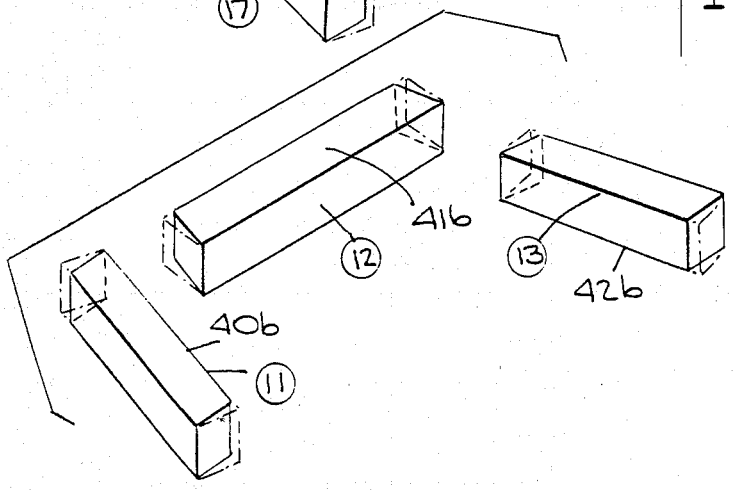
FIG. 10D is a view similar to FIG. 10C of one arrangement of the lowermost course of blocks.

Referring to FIG. 9, the various courses of masonry blocks that collectively form the firebox 25 are shown in an exploded view with the first or bottommost course illustrated in the lower right section of the drawing above the figure designator, while the topmost course appears in the upper lefthand corner of the drawing. Starting with the first course, it is formed from three Prefabricated blocks 40, 41 and 42 which blocks are illustrated in greater detail in FIGS. 11, 12 and 13, respectively.

Three blocks, identical to those in the first course, are arranged in the reverse order above the first course to produce the second course. To distinguish the blocks the reference numerals of the second course are the same as those used for the blocks of the first course with the exception that the letter "a" has been added to the number. Thus, the second course is shown as formed from blocks 40*a*, 41*a*, and 42*a*. Similarly, the third course consists of blocks 40*b*, 41*b*, and 42*b*. By reversing the order of the blocks in the first three courses, the joints are staggered in the vertical direction. A similar scheme is followed in numbering the remaining blocks in FIG. 9; where the block repeats, a letter is added to the numeral for purpose of separate reference. The numerals within the circles identify other figures of the drawings showing the respective block in greater detail. FIGS. 10A, 10B, 10C and 10D show in exploded form the blocks for the four upper courses of the structure 26.

Figures 11, 12, 13, 14, 15:
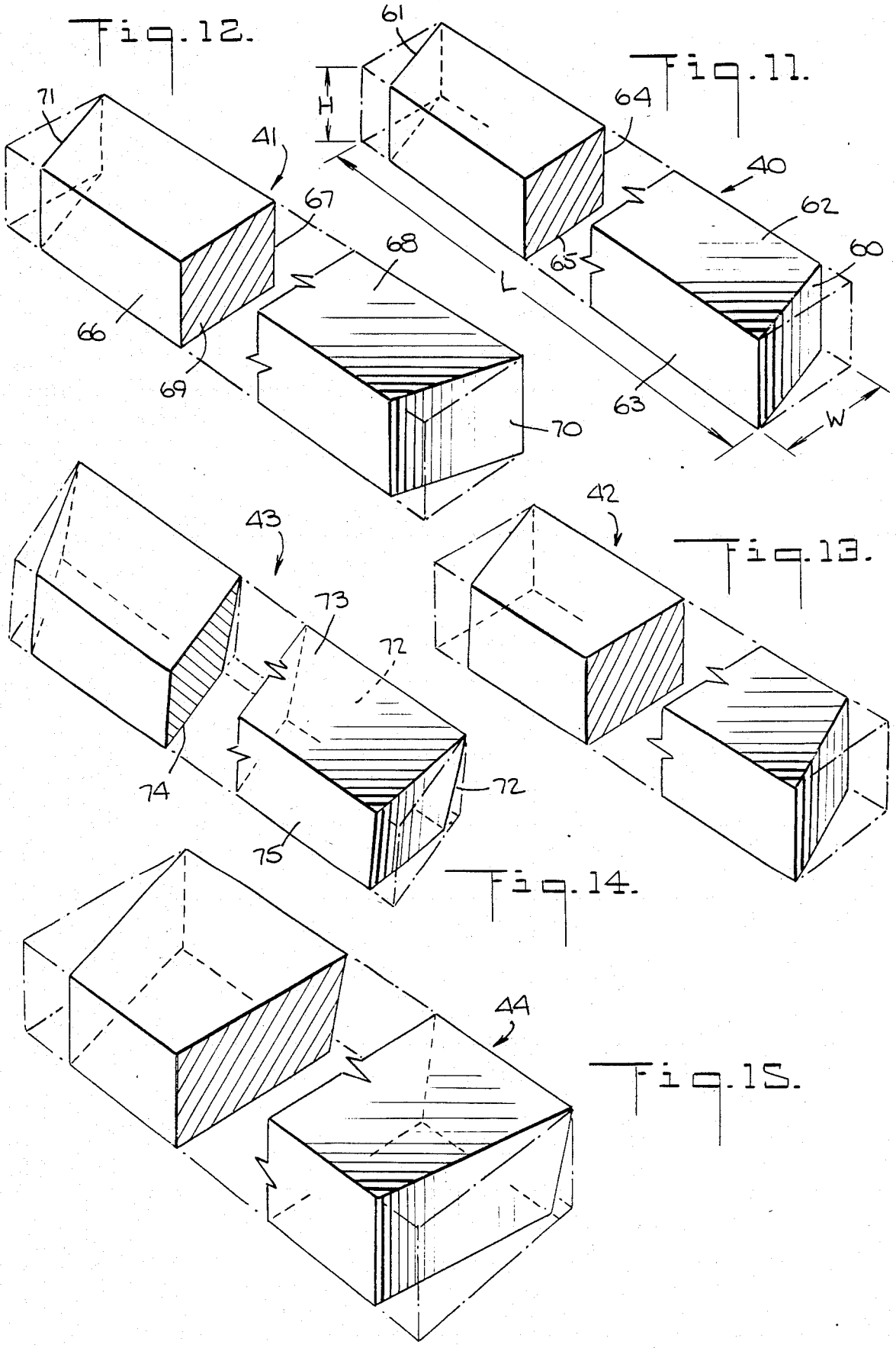
FIG. 11 is a perspective view with a phantom overlay showing the specific configuration of one of the blocks.
FIGS. 12 to 20 are views similar to FIG. 11 showing each of the other blocks constituting the assemblage of prefabricated refractory concrete blocks for erecting the firebox of FIG. 3 up to and including the course with the lintel.

Directing attention to FIG. 11, the block 40 is shown as having a rectangular cross-section and oblique or mitered end faces 60 and 61. The face 62 is rhomboid, the face 63 is rectangular as well as the opposite face 64. The bottom face 65 is also rhomboid. Thus, the block 40 is a true oblique rectangular parallelepiped if its smaller area end face 60 or 61 is considered the prism base.

Block 41 is shown in FIG. 12. The opposing faces 66 and 67 are rectangular while opposing faces 68 and 69 take the form of an equiangular trapezoid. The cross-section is rectangular. Consequently, block 41 can be classified as a truncated oblique rectangular prism or parallelepiped where the end face 70 or 71 is considered the base of the prism.

FIG. 13 illustrates block 42, it is similar to the block 40 although not as long, it being shorter by the width of block 41 measured normal to the faces 66 and 67. Block 42 is a true oblique rectangular parallelepiped, following the manner adopted for classifying the shape.

Block 43 shown in FIG. 14 is an oblique trapezoidal prism that has been truncated. Thus, in cross-section block 43 is trapezoidal, the block face 72 being beveled as best seen in FIG. 4 in order to provide the inclined firebox surface 36. In plan, the face 73 of block 43 is an equiangular trapezoid, as well as the bottom face 74. The faces 72 and 75 are both rectangular.

Figures 16, 17, 18, 19, 20:
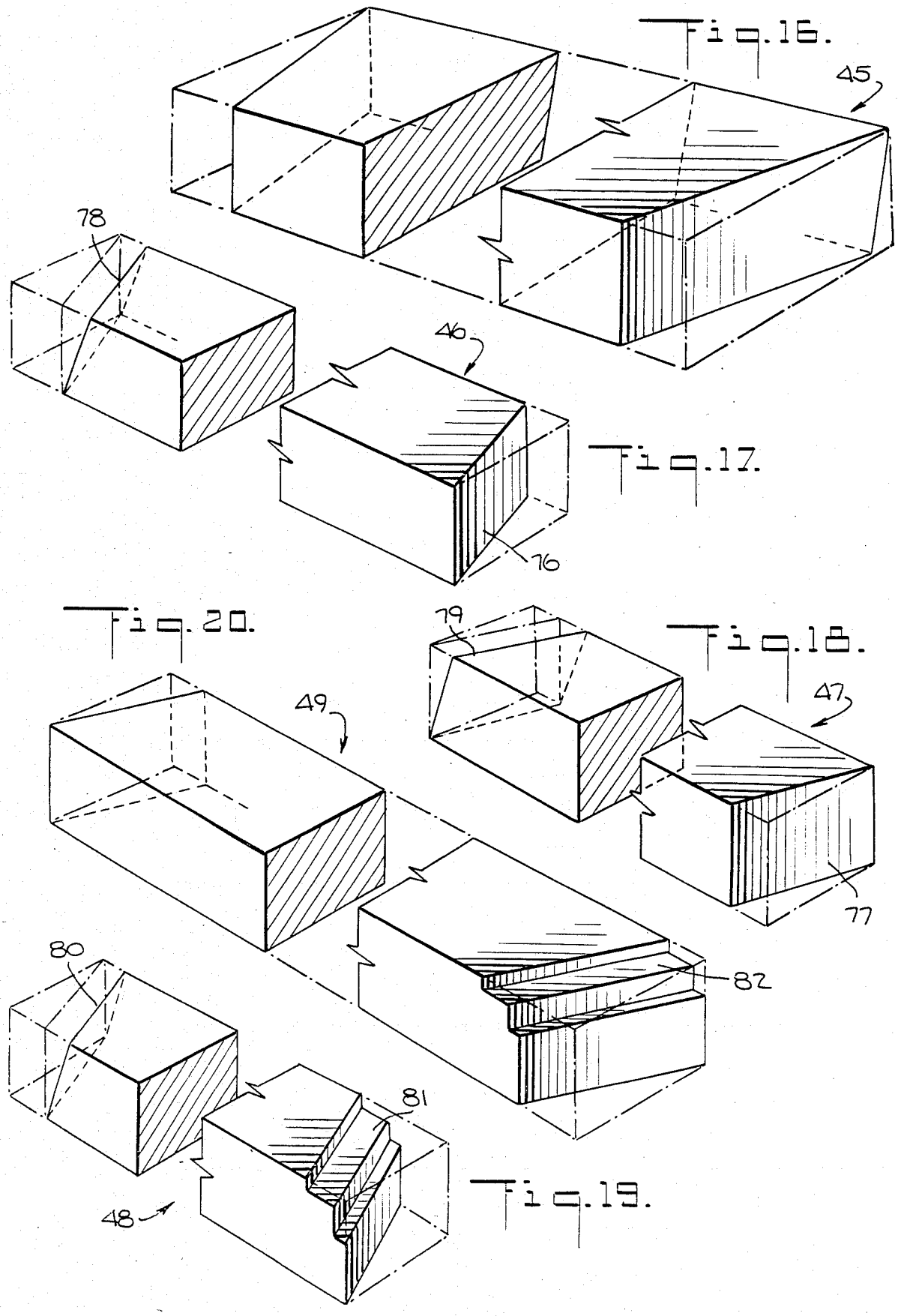

Blocks 44 and 45, shown in FIGS. 15 and 16, respectively, are similar to block 43 although wider in cross-section as evident from FIG. 4. These blocks are, therefore, oblique trapezoidal prisms that have been truncated. Again, it is assumed that one of the smaller ends corresponds to the base of the prism.

Blocks 46 and 47, shown in FIGS. 17 and 18, are somewhat more complex. Generically, they can be classified as truncated oblique rectangular prisms. They are both rectangular in cross-section. The end faces 76 and 77 are rectangular and may be thought of as the base of the prism. These faces are formed as a simple miter or bevel. However, the opposite end faces 78 and 79, respectively, are provided at a compound miter angle to mate with the sloping faces of blocks 43 and 44, respectively. For similar reason the end face 80 of block 48 is provided at a compound miter angle. See FIG. 19. The front edges 81 and 82 of blocks 48 and 49 are stepped or relieved in order to accommodate the lintel 30. Blocks 19 and 20 are in the form of oblique rectangular prisms, the block 48 being truncated, and both blocks having the stepped region, as shown.

Recapitulating, it should now be evident that the refractory concrete blocks in that part of the first structure 26 that includes the rear wall lower portion 34, are all in the form of oblique rectangular parallelepipeds. The upper portion 35 of the rear wall is formed from oblique trapezoidal prismatic blocks. The side walls 27 and 28 are formed from oblique rectangular parallelepiped blocks. There are ten differently sized and shaped blocks, the details of which are shown in FIGS. 11 to 20, respectively, from which the structure 26 is constructed. Some of the blocks, i.e., the blocks 40, 41 and 42 illustrated in FIGS. 11, 12 and 13, are duplicated to provide the fifteen blocks, laid in courses of three blocks each, that produce the U-shape structure 26. All of the duplicated blocks are in the shape of oblique rectangular parallelepipeds. In the illustrated embodiment there are five of the FIG. 11 block of a first size, three of the FIG. 13 block of a second size, and three of the FIG. 12 block of a third size, the latter also being truncated. The three truncated oblique trapezoidal prisms 43, 44 and 45 are of differing cross-sectional size as clearly evident from FIG. 4.

In order to produce a standard firebox replacement, the overall dimensions of the blocks in inches are as shown in the following table, the location of the height H, width W, and length L dimensions being typically shown in FIG. 11.

| FIG. | Block No. | H | W | L |
|---|---|---|---|---|
| 11 | 40 | 6 | 4½ | 23⅜ |
| 12 | 41 | 6 | 4½ | 29⅞ |
| 13 | 42 | 6 | 4½ | 18 15/32 |
| 14 | 43 | 6 | 6½ | 31⅛ |
| 15 | 44 | 6 | 8½ | 32 11/32 |
| 16 | 45 | 6 | 10½ | 33 19/32 |
| 17 | 46 | 6 | 4½ | 18 15/32 |
| 18 | 47 | 6 | 4½ | 16⅜ |
| 19 | 48 | 6 | 4½ | 14 9/32 |
| 20 | 49 | 6 | 4½ | 23⅜ |

A satisfactory lintel is provided by a steel angle iron 3"×3"×¼" having a length of 45". This provides a hearth opening approximately 36" wide and 34" high with an interior depth of about 16½". A modified embodiment is contemplated in which the lowermost course consisting of blocks 40, 41 and 42, is omitted. This will produce a firebox opening 28" high and 36" wide.

The blocks forming the transition cone 33 are each 7⅝" high, the course 31 producing a trapezoidal structure 40⅜" wide at the front, 28⅛" wide at the rear, and 20" deep. The course 32 produces a trapezoidal structure 27 15/16" wide at the front, 17" wide at the rear and 17 11/16" deep. With the rear wall flush from top to bottom of the structure the course 31 is set back 1" from the front of the lintel 30 while the course 32 is set back 2 5/16" from the front surface of course 31. The opening 100, see FIG. 3, at the top of the course 32, is approximately 11"×11" to tie in with a standard size chimney for this size firebox. All of the blocks in courses 31 and 32 are provided with tongue and groove joints as shown. The slope of the front wall 37 (see FIG. 4) is 2" in 7⅝".

All of the blocks are produced from a lightweight aggregate with "Lumnite" cement as a binder.

In a typical replacement situation, the worn metal firebox is removed. After inspecting and performing any needed repair to the existing hearth slab, the assemblage of prefabricated blocks are initially placed in position without mortar to ensure proper fit. Usually, some slight gap will exist between the top of the transition cone and the flue or chimney. However, during final erection this will be filled with conventional firebrick. The loosely assembled firebox is then disassembled and re-laid setting in refractory mortar and filling space behind blocks with refractory mortar and, if necessary, refractory brick. As mentioned above, the top course 32 will probably stop short of the flue and is then topped off with refractory brick.

Figure 21:
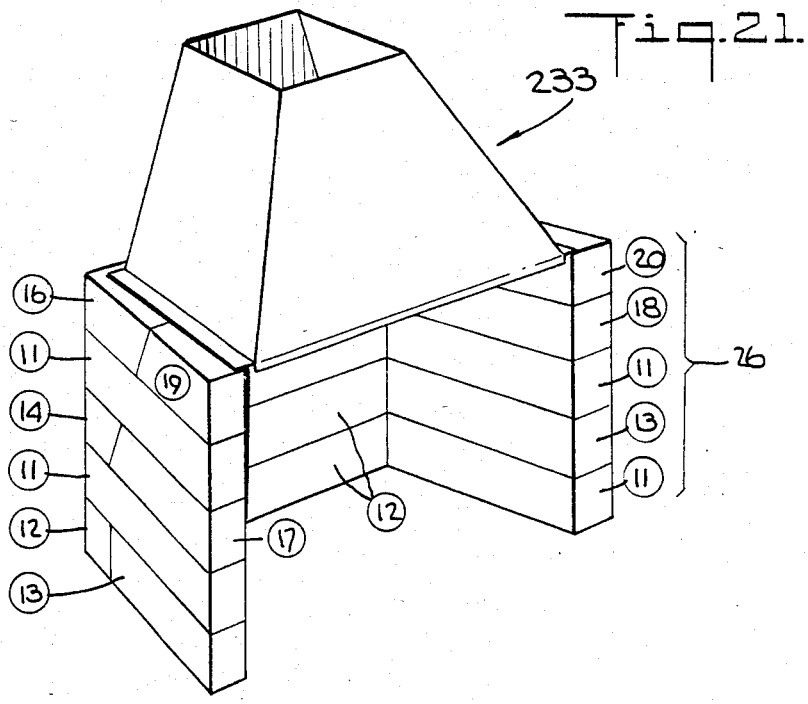
FIG. 21 is a perspective view of another embodiment of the invention utilizing a sheet metal transition cone instead of a cone of refractory masonry.

In the embodiment described above, masonry blocks are used to produce the transition cone 33. However, there are installations where a structurally self-sustaining transition cone susceptible of at least some shape and dimensional adjustment is preferable or desirable. For this purpose, the modified embodiment illustrated in FIGS. 21 and 22, can be used advantageously. As shown in FIG. 21, the bottom section of the firebox can be identical with the section 26 shown in FIGS. 3 to 5, with the exception that the steel lintel 30 is no longer required and, consequently, the blocks 48 and 49 are modified to omit the stepped recesses 81 and 82 (see FIGS. 19 and 20) that were provided to accomodate the lintel. In addition, FIG. 21 is illustrated as consisting of five courses of blocks, the bottommost course having been omitted.

Figure 22:
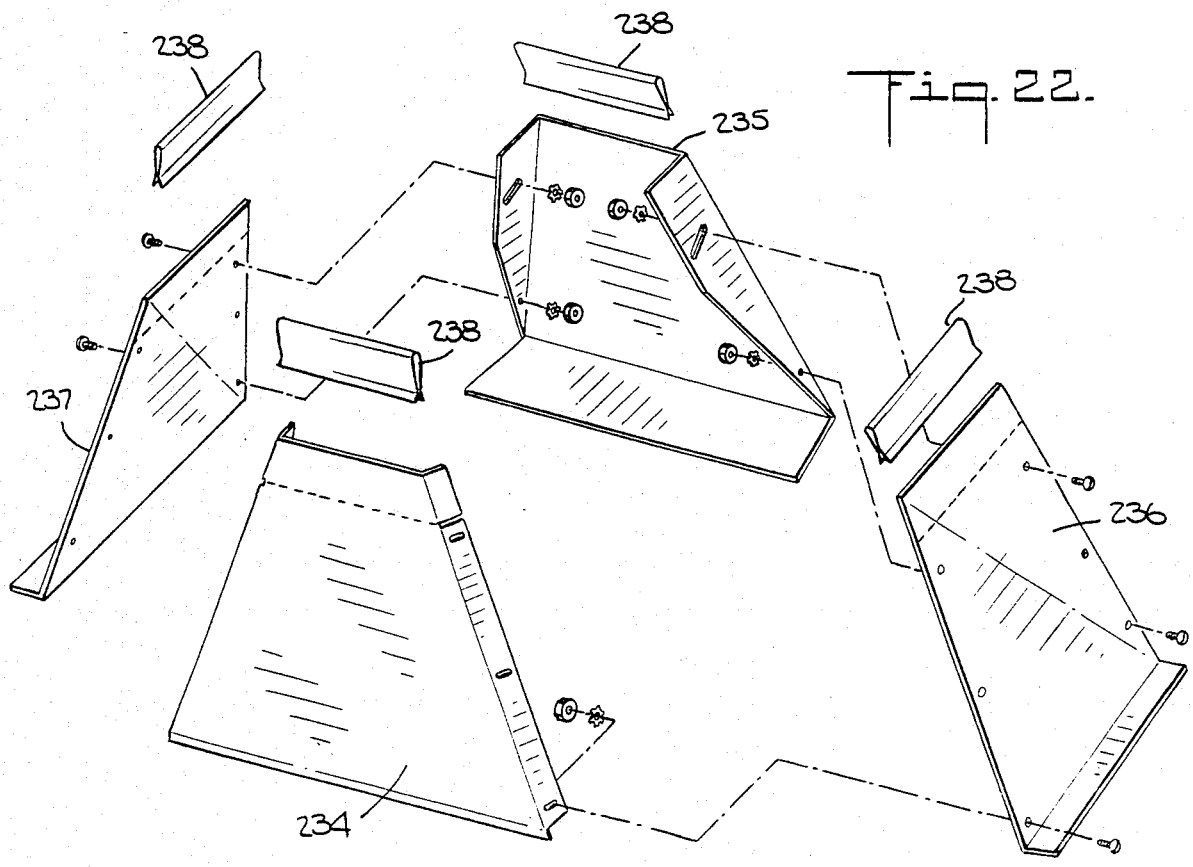
FIG. 22 is an exploded view of the components of the transition cone of FIG. 21.

The embodiment of FIG. 21 is provided with a stainless steel sheet metal transition cone 233 having the general configuration of a frustrum of a right rectangular pyramid. The cone, as seen in FIG. 22, is constructed by assembling front, back and side panels, 234, 235, 236 and 237, respectively, with stainless steel nuts, bolts and lock washers. Extender clips 238 are provided to provide an adjustable bridge between the cone structure and the existing flue or chimney.

To install the structure of FIGS. 21 and 22, the cone is loosely assembled and located as to proper installation height by stacking on top of an initial mortar-free stack of the blocks forming the bottom masonry structure. After adjusting for proper fit, the seams in the cone are caulked and the exterior is covered with a layer of glass wool insulation cemented to the metal. This has not been illustrated in the drawings. The cone is then suspended in the fireplace opening above the hearth in communication with the flue while the U-shaped masonry block structure is erected beneath it on the hearth. The components are mortared into place, and the top course is cemented to the base of the cone 233 with a suitable adhesive. The extension clips are then adjusted to contact the bottom of the flue and sealed thereto with suitable adhesive.

While the modular fireplace construction described herein is ideally suited to replacing existing firebox liners, the embodiment described with reference to FIGS. 1 to 20, utilizing a masonry transition cone, can be used advantageously with new construction. The base and transition cone provide adequate support for erecting a chimney thereover. Actually, the metal cone can also be used with original construction if suitable support can be provided for construction of the chimney. But an all masonry construction is preferred in this situation.

Having described the present invention with reference to the presently preferred embodiments thereof, it should be apparent to those skilled in the subject art that various changes in construction can be introduced without departing from the true spirit of the invention as defined in the appended claims.

What is claimed is:

1. A replacement firebox for a pre-existing open-hearth fireplace and self-supporting chimney, wherein the pre-existing fireplace comprised a standard metal firebox integrated into the fireplace construct, and wherein the standard metal firebox has been removed to leave the self-supporting chimney, said replacement firebox comprising an assemblage of prefabricated modular masonry components in which a plurality of courses of refractory concrete blocks are superposed one above the other consistent with the hearth opening and forming a U-shape first structure with facing side walls joined by a rear wall, and a transition cone located atop said first structure for interconnecting said first structure with the pre-existing chimney, said first structure having side walls of uniform thickness which diverge in the forward direction from said rear wall; said rear wall having a lower portion of uniform thickness and vertical surfaces, and having an adjacent upper portion wherein the inner surface is inclined forwardly in the upward direction; and said transition cone having a front inner surface that is inclined rearwardly in the upward direction; said U-shape first structure and said transition cone being a free-standing-unit and providing no support for said chimney.

2. A firebox according to claim 1, wherein said refractory concrete blocks in that part of said first structure that includes said rear wall lower portion are all in the form of oblique rectangular parallelepipeds.

3. A firebox according to claim 2, wherein said upper portion of said rear wall is formed from oblique trapezoidal prismatic blocks.

4. A firebox according to claim 1, wherein said upper portion of said rear wall is formed from oblique trapezoidal prismatic blocks.

5. A firebox according to claim 1, wherein said side walls are formed from oblique parallelepiped blocks.

6. A firebox according to claim 1, wherein said first structure is formed from ten differently sized and shaped blocks with each course consisting of three such blocks.

7. A firebox according to claim 6, wherein said refractory concrete blocks in that part of said first structure that includes said rear wall lower portion are all in the form of oblique rectangular parallelepipeds.

8. A firebox according to claim 7, wherein said upper portion of said rear wall is formed form oblique trapezoidal prismatic blocks.

9. A firebox according to claim 6, wherein said upper portion of said rear wall is formed from oblique trapezoidal prismatic blocks.

10. A firebox according to claim 1, wherein said transition cone comprises a cone assembled from sheet metal members to form a truncated right rectangular pyramid which rests on said side walls and has a bottom front edge bridging the opening between said side walls and defining an upper boundary of said hearth opening.

11. A replacement firebox for a pre-existing open-hearth fireplace and self-supporting chimney wherein the pre-existing open-hearth fireplace comprised a standard metal firebox integrated into the fireplace construct, and wherein said standard metal firebox has been removed to leave the self-supporting chimney, said replacement firebox comprising an assemblage of prefabricated modular masonry components in which a plurality of courses of refractory concrete blocks are superposed one above the other consistent with the hearth opening and forming a U-shape first structure with facing side walls joined by a rear wall, and a transition cone located atop said first structure for interconnecting said first structure with a chimney, said first structure having side walls of uniform thickness which diverge in the forward direction from said rear wall, said rear wall having a lower portion of uniform thickness and vertical surfaces, and having an adjacent upper portion wherein the inner surface is inclined forwardly in the upward direction, and said transition cone having a front inner surface that is inclined rearwardly in the upward direction, said transition cone comprising a metal lintel resting on said side walls, bridging the opening therebetween and defining the upper boundary of said hearth opening, and said transition cone comprising additional courses of pre-fabricated modular refractory concrete blocks which are supported on said lintel and on said first structure.

12. A method for replacing a metal firebox in a pre-existing open-hearth fireplace having a hearth slab and self-supporting chimney, wherein the pre-existing fireplace comprised a standard metal firebox integrated into the fireplace construct, said method comprising the steps of removing the metal firebox, inspecting and performing any needed repair to the hearth slab, assembling with refractory mortar on said hearth slab a plurality of courses of prefabricated refractory concrete blocks, laying one course above the previous course to the height of the hearth opening and forming thereby a U-shape first structure with facing side walls joined by a rear wall, and disposing a transition cone between said first structure and the pre-existing self-standing chimney, said first structure having side walls of uniform thickness which diverge in the forward direction from said rear wall; said rear wall having a lower portion of uniform thickness and vertical surfaces, and having an adjacent upper portion wherein the inner surface is inclined forwardly in the upward direction, wherein said transition cone has a front inner surface that is inclined rearwardly in the upward direction, and wherein said U-shaped structure and said transition cone form a free-standing unit which provides no support for the chimney.

13. A method according to claim 12, including the steps of selecting prefabricated refractory concrete blocks for constructing that part of said first structure that includes said rear wall lower portion, which selected blocks are all in the form of oblique rectangular parallelepipeds.

14. A method according to claim 13, including the steps of forming said upper portion of said rear wall with oblique trapezoidal prismatic blocks.

15. An assemblage according to claim 14, wherein a plurality of stainless steel panels are constructed for assembly into said transition cone.

16. A method according to claim 12, including the steps of selecting ten differently sized and shaped blocks, and laying three of said blocks to construct each of said courses.

17. A method according to claim 12, including the steps of assembling a plurality of generally trapezoidal sheet metal panels to form said transition cone, suspending said cone within the fireplace opening in position against the chimney, and erecting said U-shape first structure on said hearth slab to meet with the bottom of said suspended cone.

18. A method for replacing a metal firebox in a pre-existing open-hearth fireplace having a hearth slab and self-supporting chimney, wherein the pre-existing fireplace comprised a standard metal firebox integrated into the fireplace construct, said method comprising the steps of removing the metal firebox, inspecting and performing any needed repair to the hearth slab, assembling with refractory mortar on said hearth slab a plurality of courses of prefabricated refractory concrete blocks, laying one course above the previous course to the height of the hearth opening and forming thereby a U-shape first structure with facing side walls joined by a rear wall, and disposing a transition cone between said first structure and the pre-existing self-standing chimney, said first structure having side walls of uniform thickness which diverge in the forward direction from said rear wall; said rear wall having a lower portion of uniform thickness and vertical surfaces, and having an adjacent upper portion wherein the inner surface is inclined forwardly i the upward direction, wherein said transition cone has a front inner surface that is inclined rearwardly in the upward direction, and wherein said U-shape structure and said transition cone form a free-standing unit which provides no support for the chimney, said method further including the steps of disposing a metal lintel on said side walls and bridging the opening therebetween and defining the upper boundary of said hearth opening, and laying additional courses of prefabricated modular refractory concrete blocks upon said lintel and upon said first structure along with bonding refractory mortar to form a transition cone.

19. An assemblage of prefabricated refractory concrete blocks for erecting a replacement firebox for a pre-existing open-hearth fireplace and self-supporting chimney, wherein the pre-existing open-hearth fireplace comprised a standard metal firebox integrated into the firebox construct and wherein the standard metal firebox has been removed to leave the self-supporting chimney, said assemblage comprising a plurality of at least fifteen blocks wherein the plurality includes ten differently sized and shaped configuration, whereby some of said blocks are duplicated; said at least fifteen blocks, when laid in courses of three blocks, producing a U-shape structure with facing side walls joined by a rear wall, and said blocks being shaped to form said side walls with uniform thickness diverging in the forward direction, and structural members for erecting a transition cone to surmount said U-shape structure, said U-shaped structure and said transition cone when erected being a free-standing unit which communicates with but provides no support for the chimney.

20. An assemblage according to claim 19, wherein three of said configurations are duplicated.

21. An assemblage according to claim 20, wherein all of said duplicated configurations are in the shape of oblique rectangular parallelepipeds, at least four of a first size, and at least two each of a second and third size, said third size also being truncated.

22. An assemblage according to claim 21, wherein three of said configurations are not duplicated and are in the shape of truncated oblique trapezoidal prisms of differing size.

23. An assemblage according to claim 21, wherein three of said configurations are not duplicated and are in the shape of oblique rectangular parallelepipeds, at least four of a first size, and at least two each of a second and third size, said third size also being truncated.

24. An assemblage according to claim 23, wherein three of said configurations are not duplicated and are in the shape of truncated oblique trapezoidal prisms of differing size.

25. An assemblage according to claim 19, wherein three of said configurations are not duplicated and are in the shape of truncated oblique trapezoidal prisms of differing size.

* * * * *